US008490685B2

(12) United States Patent
Tolman et al.

(10) Patent No.: US 8,490,685 B2
(45) Date of Patent: Jul. 23, 2013

(54) METHOD AND APPARATUS ASSOCIATED WITH STIMULATION TREATMENTS FOR WELLS

(75) Inventors: Randy C. Tolman, Spring, TX (US); William A. Sorem, Houston, TX (US); Kris J. Nygaard, Houston, TX (US); Jeff W. Simons, Rifle, CO (US); Curtis W. Kofoed, Kuala Lumpur (MY)

(73) Assignee: ExxonMobil Upstream Research Company, Houston, TX (US)

( * ) Notice: Subject to any disclaimer, the term of this patent is extended or adjusted under 35 U.S.C. 154(b) by 786 days.

(21) Appl. No.: 11/990,480

(22) PCT Filed: Jul. 24, 2006

(86) PCT No.: PCT/US2006/028608

§ 371 (c)(1),
(2), (4) Date: Jan. 12, 2009

(87) PCT Pub. No.: WO2007/024383

PCT Pub. Date: Mar. 1, 2007

(65) Prior Publication Data

US 2009/0114392 A1 May 7, 2009

Related U.S. Application Data

(60) Provisional application No. 60/709,586, filed on Aug. 19, 2005.

(51) Int. Cl.
*E21B 43/16* (2006.01)

(52) U.S. Cl.
USPC ..... 166/52; 166/75.15; 166/90.1

(58) Field of Classification Search
USPC ..... 166/308.1, 177.5, 75.15, 52, 90.1
See application file for complete search history.

(56) References Cited

U.S. PATENT DOCUMENTS

| | | | | |
|---|---|---|---|---|
| 4,305,463 | A * | 12/1981 | Zakiewicz | 166/245 |
| 4,339,002 | A | 7/1982 | Gibbs | |
| 4,616,700 | A | 10/1986 | Wood et al. | |
| 5,531,270 | A | 7/1996 | Fletcher et al. | |
| 5,555,934 | A | 9/1996 | Haufler | |
| 5,680,899 | A | 10/1997 | Waid et al. | |

(Continued)

FOREIGN PATENT DOCUMENTS

| | | |
|---|---|---|
| GB | 1 243 062 | 8/1971 |
| GB | 2 028 400 A | 3/1980 |

OTHER PUBLICATIONS

Ammer, J. et al., "Tight Gas, Unconventional Gas: Reserve Opportunities and Technology Needs", GasTIPS, Fall 2004, pp. 22-26.

(Continued)

*Primary Examiner* — Brad Harcourt
(74) *Attorney, Agent, or Firm* — ExxonMobil Upstream Research Company - Law Department

(57) ABSTRACT

A method and apparatus associated with the production of hydrocarbons. In one embodiment, the method describes connecting multiple wells to a stimulation fluid pumping system via a pumping system manifold. The pumping system manifold is adjusted to provide a first well flow path from the stimulation fluid pumping system to a first well. Then, a first stimulation treatment is pumped into the first well. Concurrently with the pumping of the first stimulation treatment, a second well is prepared for a second stimulation treatment.

31 Claims, 6 Drawing Sheets

U.S. PATENT DOCUMENTS

| | | | | |
|---|---|---|---|---|
| 5,741,977 | A * | 4/1998 | Agar et al. | 73/861.04 |
| 6,176,312 | B1 | 1/2001 | Tubel et al. | |
| 6,192,980 | B1 | 2/2001 | Tubel et al. | |
| 6,279,658 | B1 * | 8/2001 | Donovan et al. | 166/313 |
| 6,394,184 | B2 | 5/2002 | Tolman et al. | |
| 6,520,255 | B2 | 2/2003 | Tolman et al. | |
| 6,543,538 | B2 | 4/2003 | Tolman et al. | |
| 6,575,247 | B2 | 6/2003 | Tolman et al. | |
| 6,672,405 | B2 | 1/2004 | Tolman et al. | |
| 6,745,838 | B2 | 6/2004 | Watson | |
| 6,851,444 | B1 | 2/2005 | Kohl et al. | |
| 2003/0015321 | A1 * | 1/2003 | Lim et al. | 166/263 |
| 2003/0075335 | A1 | 4/2003 | Amin et al. | |

OTHER PUBLICATIONS

European Search Report No. 113120, dated Feb. 20, 2006 for 2005UR030, 3 pages.

International Search Report and Written Opinion for 2005UR030, mailed Nov. 7, 2007, 6 pages.

* cited by examiner

METHOD AND APPARATUS ASSOCIATED WITH STIMULATION TREATMENTS FOR WELLS

CROSS REFERENCE TO RELATED APPLICATIONS

This application is the National Stage of International Application No. PCT/US06/28608, filed 24 Jul. 2006, which claims the benefit of U.S. Provisional Application 60/709,586, filed 19 Aug. 2005.

BACKGROUND

This section is intended to introduce the reader to various aspects of art, which may be associated with exemplary embodiments of the present techniques, which are described and/or claimed below. This discussion is believed to be helpful in providing the reader with information to facilitate a better understanding of particular aspects of the present techniques. Accordingly, it should be understood that these statements are to be read in this light, and not necessarily as admissions of prior art.

The production of hydrocarbons, such as oil and gas, has been performed for numerous years. To produce these hydrocarbons, one or more wells in a field are typically drilled to subsurface locations, which are generally referred to as subterranean formations, reservoirs or basins. The process of producing hydrocarbons from the subsurface formations typically involves drilling one or more wells to access the subsurface formations. With the wells drilled, completion and stimulation activities or operations may be utilized to produce the hydrocarbons, such as oil and gas, from the subsurface formations.

Because a single well may be utilized to access various regions of subsurface formations, drilling multiple wells from a single location, such as a surface pad or offshore platform, may be beneficial for certain applications. For example, in an offshore application, wells are routinely drilled from a single offshore platform due to the substantial platform installation and operational costs. Also, drilling of multiple wells from a single surface pad on land may reduce surface disturbance and environmental impact associated with well construction activities. Further, well construction activities for multiple wells at a single location may be effectively managed in the presence of surface constraints, such as topography, proximity to other buildings, and existing surface easements and right-of-ways. As such, wells located on a single surface pad may be utilized to reduce costs and enhance operations.

Despite the benefits from having multiple wells at a single location, certain combinations of operations may be complicated, restricted, or prevented by the presence of multiple wells. That is, when performing completion operations on one of the wells, the operations performed on other wells may be limited. For instance, when stimulating a well on a surface pad having multiple wells, stimulation operations are typically performed on only the single well. When the well is being stimulated, equipment and personnel have to wait because the stimulation operations are performed in a sequential manner and initiation of additional wellbore preparation operations may be deferred until completion of the stimulation operations. As a result, equipment and personnel are not efficiently utilized at the surface pad.

Accordingly, the need exists for a method, apparatus and system for enhancing operations involving multiple wells on a surface pad to reduce the time and cost associated with stimulation treatments. In particular, there is a need for new apparatus, method, and system to enable reliable and cost-effective execution of concurrent or simultaneous wellbore preparation and stimulation operations in multiple wellbores located at a single surface location.

For additional information please reference Ammer et al., "Unconventional Gas: Reserve Opportunities and Technology Needs", GasTIPS, Fall 2004, pp. 22-26; U.S. Pat. No. 5,890,536; U.S. Pat. No. 6,186,230; U.S. Pat. No. 6,394,184, U.S. Pat. No. 6,520,255, U.S. Pat. No. 6,543,538, U.S. Pat. No. 6,575,247; U.S. Pat. No. 6,672,405; U.S. Patent Publication No. 2003/0075335; and/or U.K. Patent No. 1,243,062; and/or U.K. Patent No. 2,028,400.

SUMMARY OF INVENTION

In one embodiment, a method associated with the production of hydrocarbons is described. The method describes connecting multiple wells to a stimulation fluid pumping system via a pumping system manifold. The pumping system manifold is adjusted to provide a first well flow path from the stimulation fluid pumping system to a first well. Then, a first stimulation treatment is pumped into the first well. Concurrently with the pumping of the first stimulation treatment, a second well is prepared for a second stimulation treatment.

In an alternative embodiment, another method associated with the production of hydrocarbons is described. In this method, a plurality of wells is connected to a stimulation fluid pumping system via a pumping system manifold. Then, the pumping system manifold is adjusted to provide a stimulation treatment from the stimulation fluid pumping system to one of the plurality of wells, while isolating another of the plurality of wells from the stimulation treatment concurrently with the pumping of the stimulation treatment to prepare the another well for another stimulation treatment. These adjustments to provide the stimulation fluid and isolation of the other well are repeated until each of the plurality of wells have received stimulation treatments. Then, hydrocarbons are produced from the plurality of wells once the stimulation treatments have been performed.

In a second alternative embodiment, a well system is described. In this well system, a plurality of oil field trees is located on a surface pad, wherein each of the plurality of oil field trees is associated with one of a plurality of wells. A pumping system manifold connects a stimulation fluid pumping system to the plurality of oil field trees. The pumping system manifold is configured to provide a flow path from the stimulation fluid pumping system into at least one selected well of the plurality of wells and to isolate at least one non-selected well of the plurality of wells from the stimulation fluid pumping system. Further, the wells, stimulation fluid pumping system, and pumping system manifold may be located on a single surface pad.

In a third alternative embodiment, an apparatus is disclosed. The apparatus includes a main valve associated with a stimulation fluid pumping system, well valves and piping that couples the main valve to the well valves. In this apparatus, each of the well valves is associated with one of the wells and the piping is directly supported by the surface of the Earth. The apparatus may also include a densitometer, a manifold check valve, a pressure gauge, a flow meter, and a ball-seal injector, which are each coupled to the main valve and the well valves.

In a fourth alternative embodiment, a method associated with the production of hydrocarbons is described. The method comprises connecting a first well and a second well to a first stimulation fluid pumping system via a first pumping system manifold; connecting a third well and a fourth well to a second stimulation fluid pumping system via a second pumping manifold; adjusting the first pumping system manifold to provide a first stimulation treatment to the first well and to isolate the second well for other operations; adjusting the second pumping system manifold to provide a second stimulation treatment to the third well and to isolate the fourth well; and pumping the first stimulation treatment into the first well and the second stimulation treatment into the third well concurrently with the pumping of the first stimulation treatment. Further, the method may also comprise preparing the second well for a third stimulation treatment concurrently with the pumping of the first stimulation treatment; and preparing the fourth well for a fourth stimulation treatment concurrently with the pumping of the second stimulation treatment.

BRIEF DESCRIPTION OF THE DRAWINGS

The foregoing and other advantages of the present technique may become apparent upon reading the following detailed description and upon reference to the drawings in which.

DETAILED DESCRIPTION

In the following detailed description, the specific embodiments of the present invention will be described in connection with its preferred embodiments. However, to the extent that the following description is specific to a particular embodiment or a particular use of the present techniques, this is intended to be illustrative only and merely provides a concise description of the exemplary embodiments. Accordingly, the invention is not limited to the specific embodiments described below, but rather, the invention includes all alternatives, modifications, and equivalents falling within the true scope of the appended claims.

The present technique is direct to drilling, treating, completing and producing hydrocarbons, such as oil and gas, from subterranean formations in a manner that reduces the overall costs to enable economic hydrocarbon production. In particular, the present techniques describe an apparatus and method for reducing and/or eliminating the non-productive time and resource utilization for drilling, stimulating, and completing multiple wells from a single surface pad or location. That is, the present techniques provide mechanisms to enhance production economics by enabling simultaneous or concurrent operations in the stimulation of multiple wells in a manner that reduces non-productive time for equipment, material, and/or personnel. As such, the present techniques may reduce the cost and time associated with performing operations for stimulation treatments of wells.

Accordingly, the present techniques may be applicable to land-based wells with two or more wells are located on a single surface pad and/or offshore-based wells where two or more wells are located on a single platform location. The present techniques utilize procedures and equipment that allow stimulation treatments to be performed more efficiently. In particular, the present techniques involve connecting two or more wells to a stimulation fluid pumping system via a well coupling system, such as a pumping system manifold. This pumping system manifold contains multiple valves to enable stimulation fluid to be pumped into any selected well, while the other remaining wells are hydraulically isolated from the pressure and energy created by the stimulation fluid pumping system. By isolating the other wells, other operations or activities, such as preparations for the next well to be stimulated or producing hydrocarbons, may be performed on the other wells. As a result, the present techniques enhance the stimulation process for multiple wells located at a single location, such as a surface pad.

Figure 1:
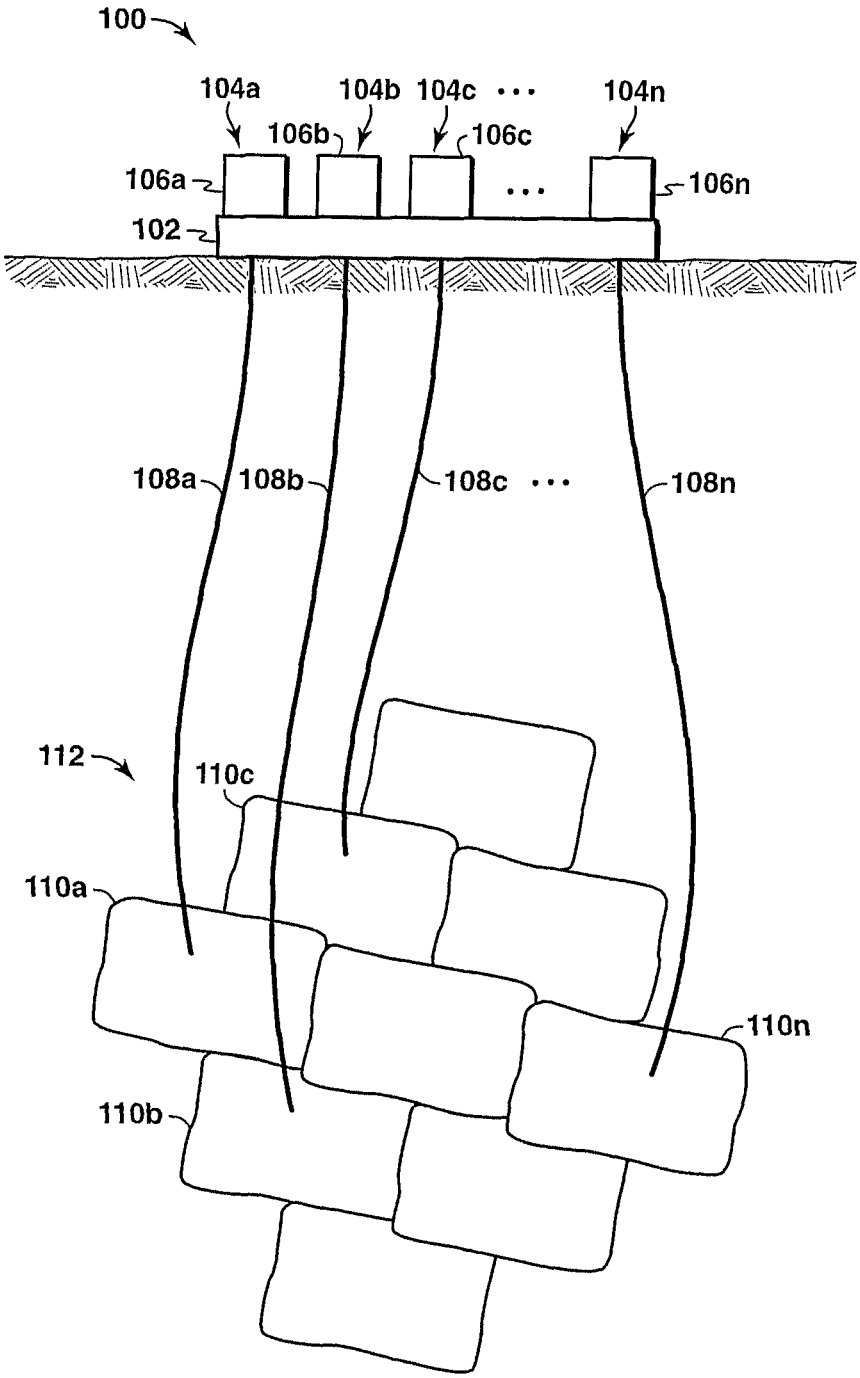
FIG. 1 is an exemplary production system having multiple wells located on a surface pad in accordance with certain aspects of the present techniques.

Turning now to the drawings, and referring initially to FIG. 1, an exemplary production system 100 having multiple wells located at a single surface pad in accordance with certain aspects of the present techniques is illustrated. In the production system 100, a surface pad 102 has two or more wells 104*a*-104*n*. Each of the wells 104*a*-104*n* has an oil field tree 106*a*-106*n* located over the wellbore 108*a*-108*n* and are positioned in a specific configuration. These wellbores 108*a*-108*n* follow specific trajectories that access one or more specific zones or regions 110*a*-110*n* of a subsurface formation 112. The wellbores 108*a*-108*n* along with any casing or tubing strings utilized may provide flow paths from the respective regions 110*a*-110*n* to one of the trees 106*a*-106*n* for hydrocarbons, such as oil and gas. Within the wellbores 108*a*-108*n*, casing strings or tubing (not shown) may be disposed to support the walls of the wellbore 108*a*-108*n*. It should be understood that "n" may be any number of such units that can be utilized. Further, it should be noted that the production system 100 is illustrated for exemplary purposes and the present techniques may be useful in the production of fluids from any location, which may include offshore or onshore applications and other equipment, as well.

Because the wells 104*a*-104*n* may be drilled in a variety of directions with different trajectories, drilling the wellbores 108*a*-108*n* from a single location may provide access to various lateral and vertical locations, such as the regions 110*a*-110*n* of the subsurface formation 112. In fact, the wellbores 108*a*-108*n* may penetrate the subsurface formation 112 at specific target locations or regions 110*a*-110*n* that extend substantial lateral distances from the location of the surface pad 102. The effective drainage area associated with regions 110*a*-110*n* may vary because the resource recovery is influenced by a number of parameters, such as the number of wells drilled, spacing of wells, reservoir properties, and stimulation treatment design and effectiveness. For example, deviated wells may be drilled to depths greater than 20,000 ft with lateral throws greater than 5,000 ft. As such, a single surface pad 102 may include wells 104*a*-104*n* that access and effectively drain hydrocarbon reservoirs, such as subsurface formation 112, which may be an area greater than approximately 640 acres.

For certain types of subsurface formations 112, such as low permeability ("tight") gas formations, different stimulation treatments may be utilized to access intervals or zones within the wellbore 108*a*-108*n*. These stimulation techniques or treatments may include hydraulic proppant fracture stimulation and completion technologies to enable commercial development of this type of subsurface formations. For instance, new multi-zone stimulation and completion methods and equipment for the use of these methods are described in U.S. Pat. No. 6,394,184, U.S. Pat. No. 6,520,255, U.S. Pat. No. 6,543,538, U.S. Pat. No. 6,575,247 and U.S. Pat. No. 6,672,405, which are incorporated by reference, which describe techniques and tools for stimulating subsurface formations containing multiple hydrocarbon targets at reduced cost compared to conventional single-zone treatment approaches. As disclosed in the patents, the Just-in-Time Perforating ("JITP") and the Annular-Coiled Tubing Fracturing ("ACT-Frac") technologies, methods, and devices provide stimulation treatments to multiple subsurface formations targets within a single wellbore. In particular, the JITP and the ACT-Frac techniques: (1) enable stimulation of multiple target zones or regions via a single deployment of downhole equipment; (2) enable selective placement of each stimulation treatment for each individual zone to enhance well productivity; (3) provide diversion between zones to ensure each zone is treated per design and previously treated zones are not inadvertently damaged; and (4) allow for stimulation treatments to be pumped at high flow rates to facilitate efficient and effective stimulation. As a result, these multi-zone stimulation techniques have been developed to enhance hydrocarbon recovery from subsurface formations that contain multiple stacked subsurface intervals of hydrocarbons within regions of a well.

However, performing these stimulations may include a range of supporting operations that preclude pumping operations in the well at the time of the supporting operation is performed. For instance, non-pumping operations are usually performed when applying these multi-zone stimulation technologies to wells that are stimulated over one or more days. Accordingly, in performing these operations, it may be preferred to set bridge plugs or frac plugs between sets of intervals being treated by the stimulations. Setting these plugs may take substantial time, such as two or more hours depending on the well depth and operating speed of the wireline equipment. During the installation of the plug, it is not possible to perform stimulation treatment pumping operations in the well, which are an expensive portion of the stimulation operation. As a result, for wells containing many zones, the time associated with non-pumping operations may result in substantial incremental costs due to the cost structure associated with time-based equipment and crew fees.

As a specific example, nine wells may be drilled from a single surface location, such as the surface pad 102, which is six-acre section of land. Each of the nine wells may be drilled with trees positioned in two rows on the surface pad 102 and separated from each other by approximately fifteen feet. In this manner, the wells may be clustered in a relatively small portion of the surface pad 102 to provide additional space for other equipment that may be used in the stimulation treatments. Eight of the wells may be drilled with s-shape well trajectories, while one of the wells may have a vertical trajectory. Each of these wells may end at a bottomhole location that provides drainage for subsurface formation 112 for about a nominally 20 acre well spacing. Hence, the nine wells may drain about 180 acres from a single six acre surface location.

Figure 3:
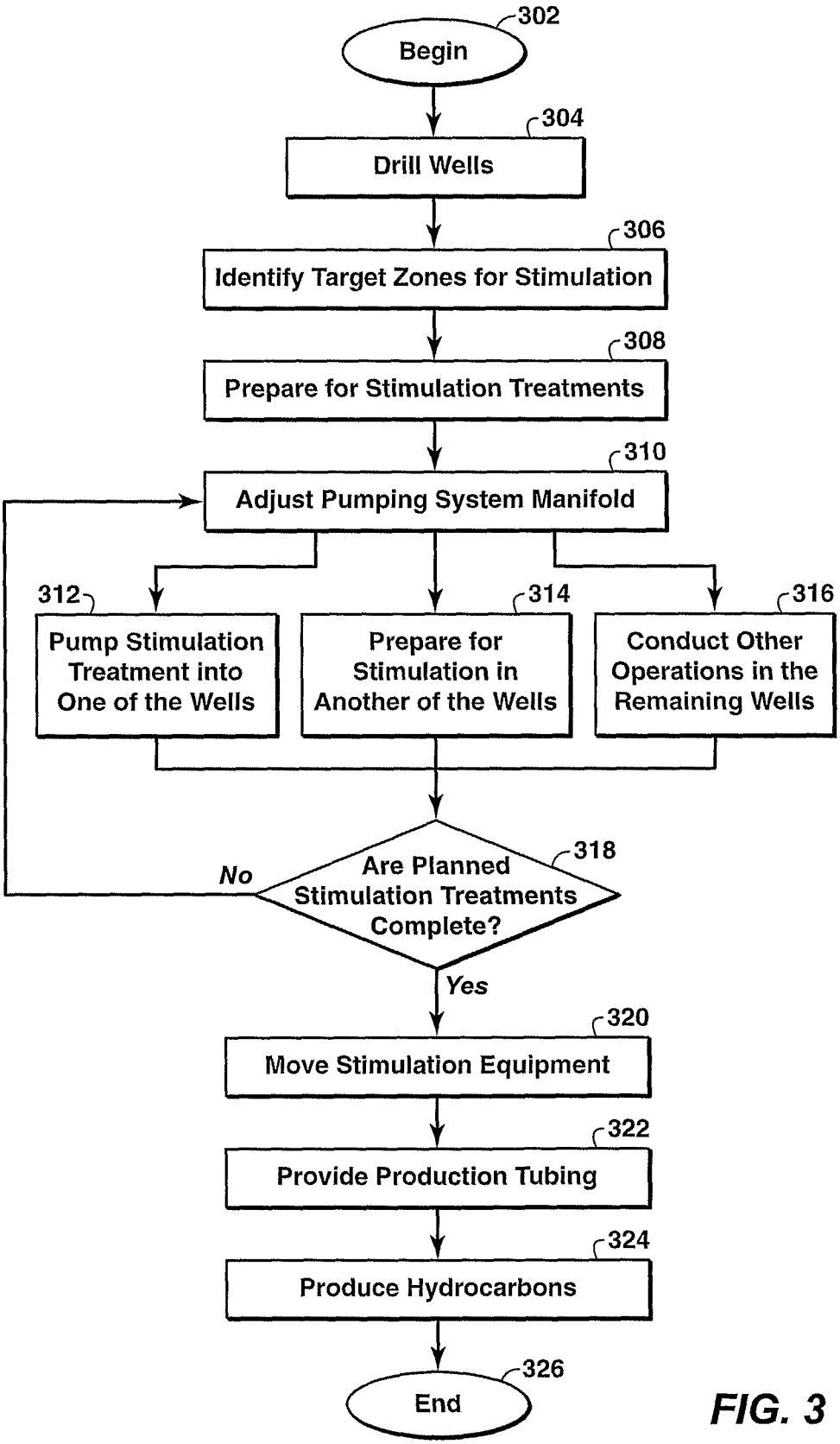
FIG. 3 is an exemplary flow chart of operations performed on the wells located on the surface pad of FIG. 1 in accordance with aspects of the present techniques.
Figure 4A:
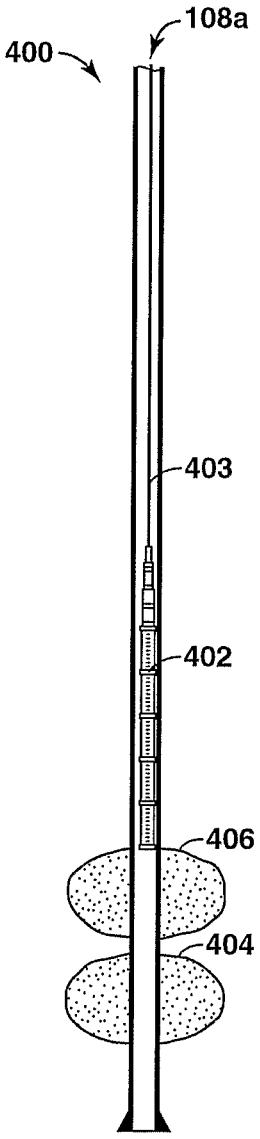
FIGS. 4-6 are partial views of wells being utilized in concurrent operations associated with stimulation treatments according to the process of FIG. 3 in accordance with certain aspects of the present techniques.
Figure 4B:
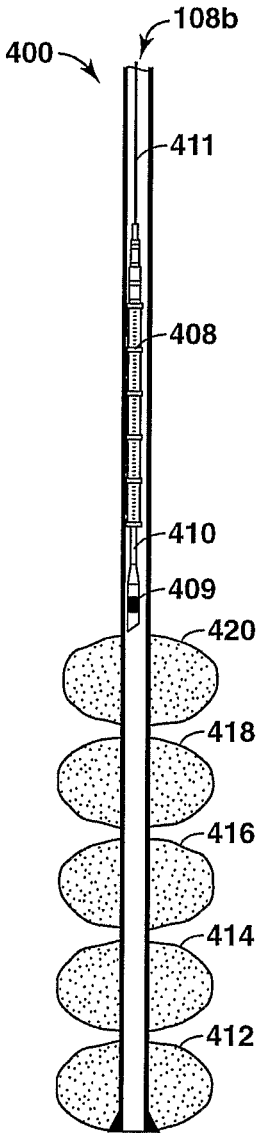
Figure 4C:
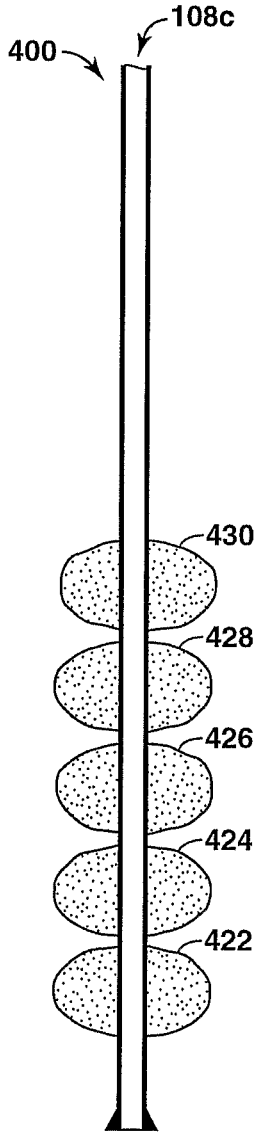
Figure 5A:
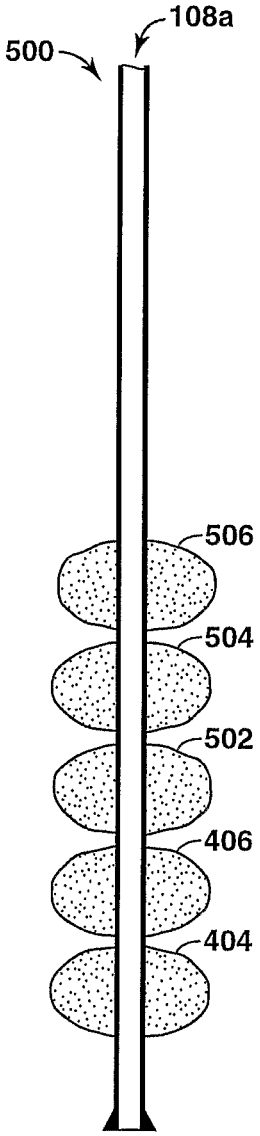
Figure 5B:
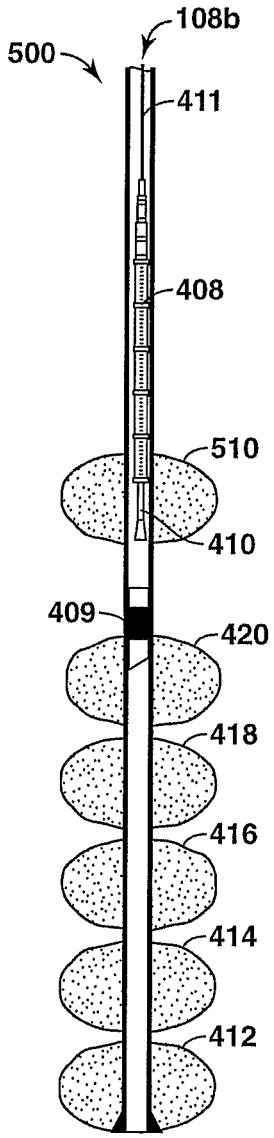
Figure 5C:
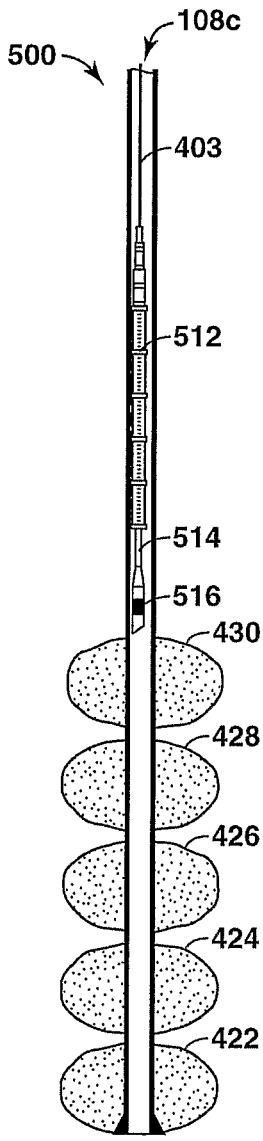
Figure 6A:
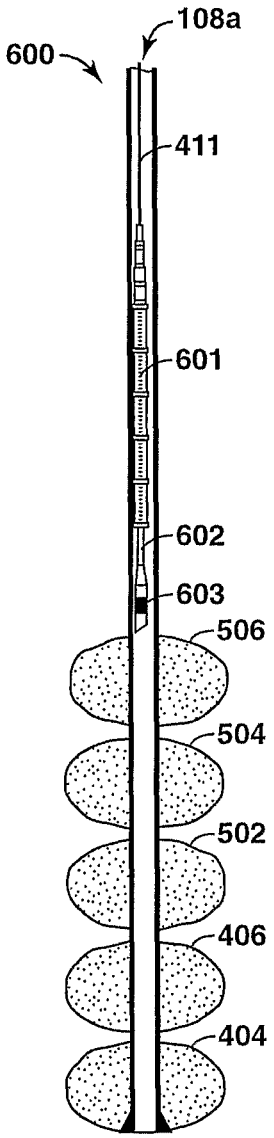
Figure 6B:
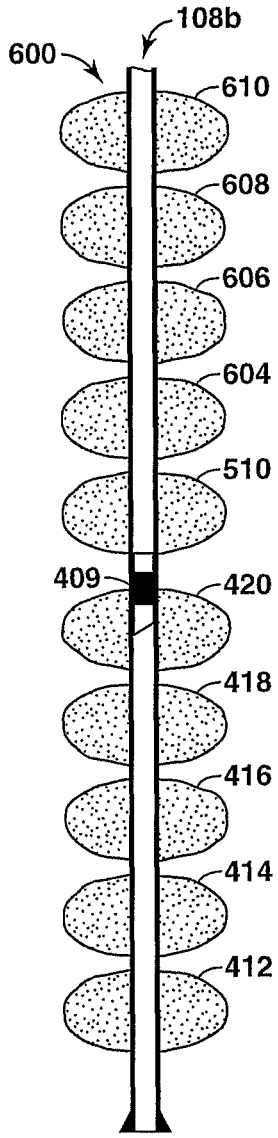
Figure 6C:
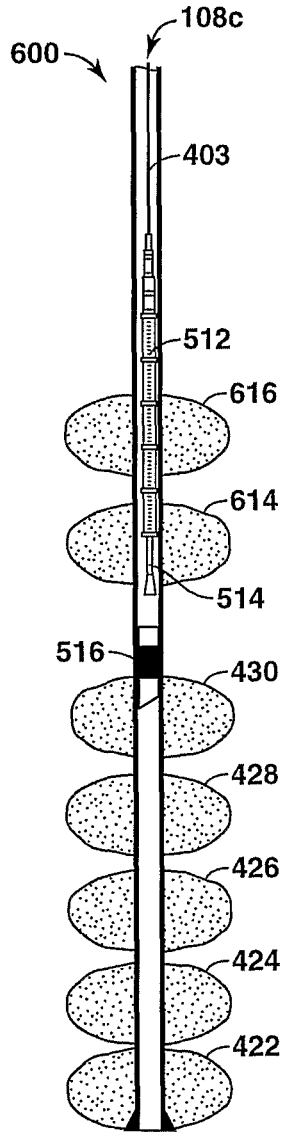

To enhance the stimulation, completion and production process from these wells on a surface pad, the operations performed on the individual wells may be coordinated and utilize mechanisms to perform these operations in an efficient manner. Accordingly, in FIG. 2, a surface pad configuration is shown with different equipment that may be utilized to perform the stimulation treatments in accordance with the present techniques. An exemplary flow chart is shown in FIG. 3 that describes possible concurrent operations that may be performed to enhance the operation of the wells of FIGS. 1 and 2. FIGS. 4-6 illustrate views of wells with different operations being performed on the wells in accordance with the process of FIG. 3. Accordingly, by utilizing the present techniques, simultaneous or concurrent operations involving stimulation of two or more wells located at a single surface pad may be performed in an efficient manner.

Figure 2:
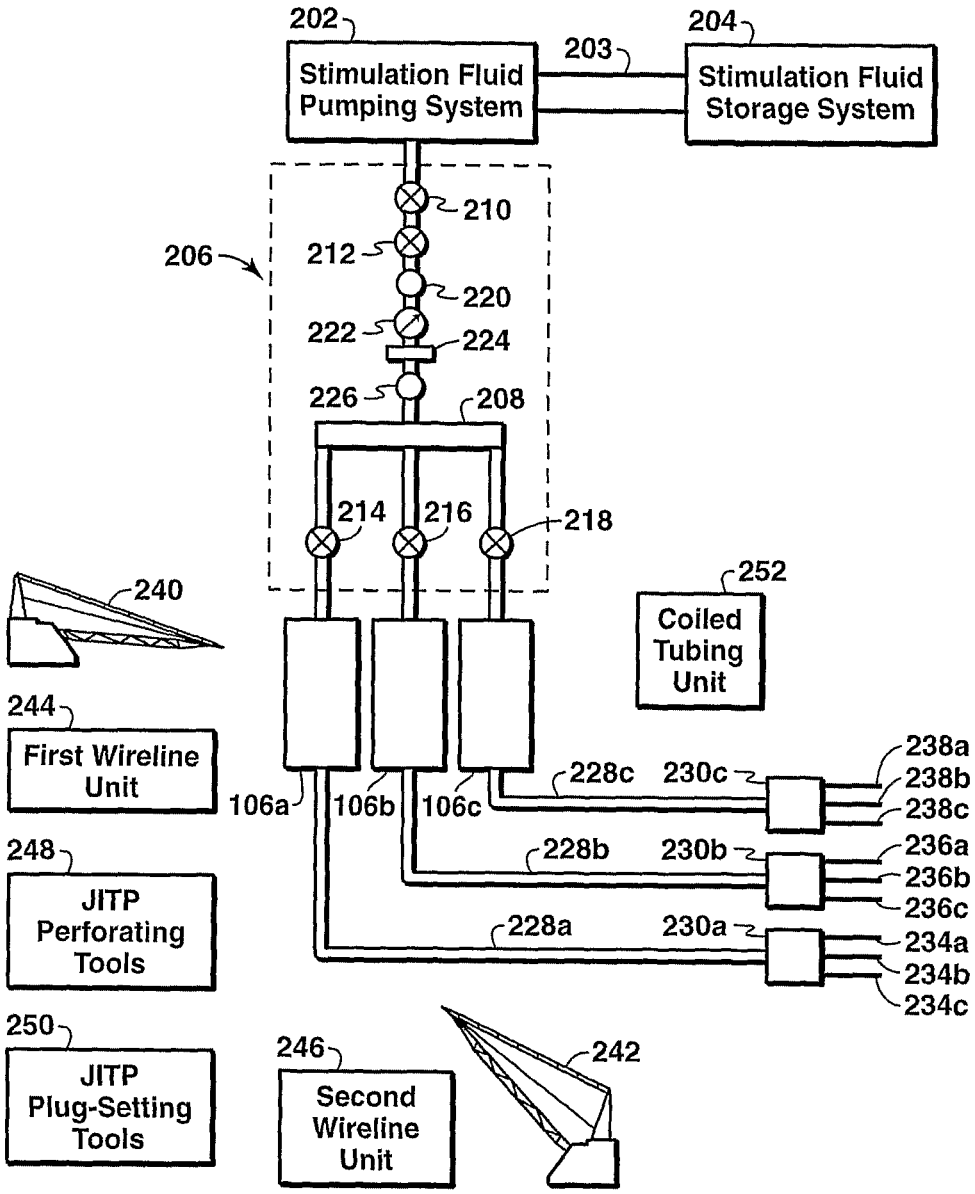
FIG. 2 is an exemplary surface pad configuration with equipment and wells for use with the production system of FIG. 1 in accordance with certain aspects of the present techniques.

FIG. 2 is an exemplary surface pad configuration with equipment and wells for use with the production system 100 of FIG. 1 in accordance with certain aspects of the present techniques. In FIG. 2, the configuration of surface equipment involved with stimulation treatments by a JITP hydraulic proppant fracture stimulation of three wells 104*a*-104*c* on the surface pad 102 is shown. In particular, to support the JITP hydraulic proppant fracture stimulation operations, the equipment on the surface pad 102 may include a stimulation fluid pumping system 202, a stimulation storage system 204, a well coupling system, such as a pumping system manifold 206, and flowback manifolds 230*a*-230*c*, for example. However, it should be understood that the JITP hydraulic proppant fracture stimulation system is only for exemplary purposes as other types of stimulation systems may also be utilized, including both multiple stage stimulation and single stage stimulation systems.

Generally, the wells 104*a*-104*c* produce hydrocarbons through piping 228*a*-228*c* that is coupled between the respective oil field trees 106*a*-106*c* and the flowback manifolds 230*a*-230*c*. The piping 228*a*-228*c* may include high pressure steel lines utilized in oil field applications. The flowback manifolds 230*a*-230*c* may also be coupled to one or more flowlines 234*a*-234*c*, 236*a*-236*c* and 238*a*-238*c*, respectively. These flowlines 234*a*-234*c*, 236*a*-236*c* and 238*a*-238*c* may be coupled to flowback pits, flow test units, sales lines, tankage, oil/gas/water separating and processing units and/or other similar devices. Thus, the hydrocarbons from the wells 104*a*-104*c* typically flow through the flowback manifolds 230*a*-230*c* for further processing or sales.

To provide a stimulation treatment, the JITP system may include the stimulation fluid pumping system 202 and stimulation fluid storage system 204. The stimulation fluid pumping system 202 couples to the stimulation fluid storage system 204 via piping 203, which may be high pressure steel lines or low pressure hoses depending on the specific application. The stimulation fluid storage system 204 is a vessel that holds a sufficient volume of fluid for the planned stimulation treatments. It is noted that the stimulation fluid storage system 204 may include tanks located on the surface pad 102, a pit dug on the surface pad 102, and/or a pond, lake, river or water storage facility located in close proximity to the surface pad 102.

To couple the stimulation fluid pumping system 202 to the trees 106*a*-106*c*, the pumping system manifold 206 is utilized. The pumping system manifold 206 may include various components utilized to manage access to the wells 104*a*-104*c* from the stimulation fluid pumping system 202. For instance, the pumping system manifold 206 may include a set of pipes 208 to interface each of the trees 106*a*-106*c* with the stimulation fluid pumping system 202. To manage the flow paths through the pipes 208, a main manifold valve 210 and a manifold check valve 212 may be located near the stimulation fluid pumping system 202, while a first manifold well valve 214, second manifold well valve 216, and a third manifold well valve 218 may be located near each of the trees 106*a*-106*c*, respectively. Each of the trees 106*a*-106*c* may be connected to the first manifold well valve 214, second manifold well valve 216, and a third manifold well valve 218, respectively, or utilize other devices to couple to the trees 106*a*-106*c*. Valves 210, 214, 216 and 218 may be any type of valve, including those routinely used in oil-field applications, such as gate valves or ball valves, while the manifold check valve 212 may be configured to allow fluid flow from the stimulation fluid pumping system 202, but to prevent reverse flow of fluids into the stimulation fluid pumping system 202. These valves 210, 214, 216 and 218 may be actuated or positioned to a full-open or full-closed position to provide hydraulic isolation between individual wells 104*a*-104*c* and the stimulation fluid pumping system 202. While it may be beneficial for the valves 210, 212, 214, 216 and 218 to seal in a "leak-tight" position, in some applications, it may be acceptable to perform operations with leaky hydraulic seals. In addition, the pumping system manifold 206 may include a densitometer 220, pressure gauge 222, ball-sealer injector 224 and/or flowmeter 226, which may be coupled along the piping 208 near the main manifold valve 210. However, it should be understood that the specific configuration of components described in the pumping system manifold 206 is for exemplary purposes, and other configurations and placement of components may be utilized for additional functionality.

Through the coupling of the valves 210, 212, 214, 216 and 218, flow paths may be provided through the pumping system manifold 206. Because the first manifold well valve 214, second manifold well valve 216, and a third manifold well valve 218 may be set to an open or closed position, stimulation fluid may be injected into one or more of the wells 104*a*-104*c*, while the other wells 104*a*-104*c* may be isolated by at least one of the valves 214-218 from the stimulation fluid pumping system 202. To enhance reliability, it may be preferred that two valves, such as a manifold well valve 214-218 and a valve (not shown) on the tree 106*a*-106*c*, are closed during any given isolation from the other wells. Additionally, it may also be preferred that at least one or more valves be installed on trees 106*a*-106*c* and that valves in the open position are marked during the stimulation operations.

Further, other equipment may also be utilized on the surface pad 102. For instance, a first crane 240 and a second crane 242 may be utilized to suspend stimulation equipment, such as a JITP lubricator system. These cranes 240 and 242 may be located in a fixed position that may access any of the wells 104*a*-104*c* or may be mobile to provide access to any of the wells 104*a*-104*c*. Also, a first wireline unit 244 and a second wireline unit 246 may be used for deploying and activating JITP perforating tools 248, such as perforating guns, and plug-setting tools 250, which may include plugs, in the wells 104*a*-104*c*. In addition, a coiled tubing unit and/or workover rig 252 may be utilized to remove plugs and install production tubing within the wells. The use of the stimulation equipment is further explained below in FIG. 3.

FIG. 3 is an exemplary flow chart of operations that may be performed on the wells 104*a*-104*c* located on the surface pad 102 of FIG. 1 in accordance with aspects of the present techniques. This flow chart, which is referred to by reference numeral 300, may be best understood by concurrently viewing FIGS. 1 and 2. In this flow chart 300, various operations may be performed on wells 104*a*-104*n* in a concurrent or substantially simultaneous manner to reduce costs and time associated with stimulating wells. For exemplary purposes, these operations may be specific to JITP hydraulic proppant fracture stimulation operations, which may include the equipment described in FIG. 2. However, it should again be noted that other stimulation techniques or other operations may be performed under the present techniques.

The flow chart begins at block 302. At block 304, the wells 104*a*-104*c* are drilled on the surface pad 102. The drilling operations may include installing the production casing and cementing the production casing into the wellbore 108*a*-108*c*. The drilling operations may also include setting the trees 106*a*-106*c*. Then, the target zones to be stimulated within the completion interval may be identified, as shown by block 306. The identification of the target zones may be performed by using open-hole and/or cased-hole logs to identify zones that include hydrocarbons.

Once the target zones are identified, the stimulation operations may be performed, as shown in blocks 308-318. To begin, it should be noted that these stimulation operations may include various activities, such as pumping operations, wireline operations, flowback operations, and other logistical coordination operations. The pumping operations may include high pressure pumping; JITP ball arrival and pressure events; screen-out mitigation and sand flowback; and manipulating pumping manifold valves, wellhead tree valves and/or flowback manifold valves. The wireline operations may include wireless radio and hard wired radios communications; arming perforating guns and plug setting tools; picking-up and laying down perforating guns and plug setting tools; moving wireline in and out of the wellbores; pulling on the wireline to free stuck tools; installing or retrieving perforating guns; and/or raising or lowering man-lifts for personnel access to equipment located off the surface pad 102. The flowback operations may include flowing back the well, manipulating choke manifold valves; producing gas to the sales line; and/or venting and flaring gas to the atmosphere. Logistical coordination operations may include water recycling pumping and filtering; proppant delivery; chemical delivery; water hauling; and/or communicating with crews via cellular phones or radios.

In addition, other drilling-related operations, completion-related and production-related operations may be performed on another or a second well. For instance, other operations may include drilling another well; installing tubing into another well; installing a plug within another well; removing debris from another well; removing the plug from another well; installing production tubing in another well; removing production tubing from another well; moving equipment on the surface pad; delivering material on the surface pad; injecting fluid in another well; manipulating valves; performing coiled tubing operations in another well; performing logging operations in another well; producing hydrocarbons from another well; delivering equipment or materials on the surface pad and/or removing equipment or materials from the surface pad.

Accordingly, the surface pad 102 is prepared for the stimulation operations, as shown in block 308. The preparations may include coupling the piping 228*a*-228*c*, manifold valves 230*a*-230*c* and flowlines 234*a*-234*c*, 236*a*-236*c* and 238*a*-238*c* together and coupling the pumping system manifold 206 to the trees 106*a*-106*c* and the stimulation fluid pumping system 202. The pumping system manifold 206 may be coupled to any number of wells with the appropriate valves, flow measurements devices, flow control devices. With the equipment in place, the pumping system manifold 206 may be adjusted to prepare a specific well to receive the stimulation treatment, while the other wells are isolated from the stimulation treatment, as shown in block 310. As an example, for the stimulation treatment to flow into the first well 104*a*, the main manifold valve 210 and first manifold well valve 214 may be placed in the open position, while the second manifold well valve 216 and third manifold well valve 218 may be placed in the closed position to isolate the second and third wells 104*b* and 104*c*.

Once the pumping system manifold 206 is configured, a stimulation treatment may be pumped into the one of the wells, as shown in block 312. Concurrently, with the stimulation treatment of one of the wells, another well may be prepared for stimulation treatments, as shown in block 314, while other operations may be conducted in the remaining wells, as shown in block 316. The preparations may include using the crane 240 and wireline unit 244 to install and run the JITP perforating tools 248 and plug-setting tools 250 into the another well, performing flow-back operations, performing other wireline operations, injecting fluids or materials, and performing plug removal operations and/or other operations, as discussed further below. By preparing another well concurrently with the stimulation of a first well, the other well may be ready for the stimulation treatment when the stimulation treatment is completed in the first well. In this manner, the execution of simultaneous operations performed on the other wells may reduce "non-pumping" time between the first stimulation treatment of the first well and a second stimulation treatment of another well, and reduce the time and cost of the stimulation operation.

After the first stimulation treatment is completed, a determination is made whether the planned stimulation treatments for the wells are completed, as shown in block 318. If the planned stimulation treatments for the wells are not complete, then the pumping system manifold 206 may be adjusted to prepare for the next well. That is, the valves in the pumping system manifold 206 are positioned in the appropriate open or closed positions to enable stimulation fluid injection into another of the wells, which is to receive the second stimulation treatment. Again, concurrent or simultaneous operations, such as conveyance of JITP perforating tools 248 and plug-setting tools 250 downhole on wireline and/or flow-back operations may be performed if a third stimulation treatment is to be performed. These simultaneous operations are conducted to prepare other wells for the stimulation treatments with reduced non-pumping time between each of the stimulation treatments. The above process of sequentially manipulating the valves of the pumping system manifold, as shown in block 310, and pumping stimulation treatments in the wells, while simultaneously performing operations to prepare other wells for further stimulation treatments may be repeated until each of the planned stimulation treatments is completed.

If the planned stimulation treatments for the wells are complete, then the equipment associated with the stimulation treatments may be rigged-down and moved off the surface pad 102, as shown in block 320. Then, a workover rig or coiled tubing unit 252 may be located at the surface pad 102 to drill-out the plugs and run production tubing in each of the wells, as shown in block 322. With the production tubing installed, the wells may be utilized to produce hydrocarbons, as shown in block 324. Accordingly, the process ends at block 326.

Beneficially, the present technique reduces the time associated with stimulating multiple wells on a surface pad by performing concurrent operations on two or more of the wells. Also, by saving time, the present technique reduces the cost of performing stimulations on these wells. Further, the use of the pumping system manifold reduces or eliminates the potential safety hazards and additional time delays associated with rig up and/or rig down of high pressure lines from the stimulation fluid pumping system to the individual wells, which may occur multiple times over the course of many days with the use of conventional methods. A specific example of the present techniques is process below and described in greater detail in FIGS. 4-6.

FIGS. 4-6 are partial views of wells 104*a*-104*c* being utilized to perform concurrent stimulation operations according to the process of FIG. 3 in accordance with certain aspects of the present techniques. The partial views of FIG. 4-6, which are referred to by reference numerals 400, 500 and 600, respectively, may be best understood by concurrently viewing FIGS. 1 and 2. In these partial views 400, 500 and 600, three wells 104*a*-104*c* from the surface pad 102 are shown with different operations being performed on each of the wells 104*a*-104*c* in a concurrent or substantially simultaneous manner.

For exemplary purposes, the operations performed in FIGS. 4-6 may be specific to a five-stage JITP hydraulic proppant fracture treatment, which may be referred to as a stimulation treatment or JITP fracture treatment. Accordingly, each stage of the JITP fracture treatment includes different sub-stages. These sub-stages are as follows: (a) 5,000 gallons of 2% potassium chloride water solution; (b) 2,000 gallons of guar-based linear gel fracture fluid containing 1 pound-per-gallon of proppant; (c) 3,000 gallons of guar-based linear gel fracture fluid containing 2 pounds-per-gallon of proppant; (d) 10,000 gallons of guar-based linear gel fracture fluid containing 3 pounds-per-gallon of proppant; and (e) 3,000 gallons of guar-based linear gel fracture fluid containing 4 pound-per-gallon of proppant such that 50,000 pounds of proppant and 23,000 gallons (approximately 547 barrels of fluid) of stimulation fluid are used in each stage of the JITP fracture treatment. Then, the pumping may be performed at an average rate of 20 barrels/minute. As a result, the pumping time for each stage may take approximately 27 minutes. Hence, the pumping time for a JITP fracture treatment may be approximately 2 hours and 15 minutes for each well. The following partial views 400, 500 and 600 are described in greater detail in each of the FIGS. 4-6 below.

To begin, in FIG. 4, the first well 104*a* may be stimulated using the JITP fracture treatment. It should be noted that for this stimulation treatment, the main manifold valve 210 and first manifold well valve 214 are in the open position, while the second manifold well valve 216 and third manifold well valve 218 are in the closed position to create a first well flow path. Also, a wireline-deployed JITP perforating gun 402, which may be one of the JITP perforating tools 248, is suspended via wireline 403 in the wellbore 108*a* using the first crane 240. This JITP perforating gun 402 is actuated and controlled from the first wireline unit 244. In the first well 104*a*, proppant fracture 404 has been placed into the region 110*a* of the subsurface formation 112. The stimulation fluid is pumped down the wellbore 108*a* to create a proppant fracture 406.

Concurrently, preparation operations may also be performed in the second well 104*b*. In the second well 104*b*, a wireline-deployed JITP perforating gun 408, which is another of the JITP perforating tools 248, and a frac plug setting system 410 having a composite frac plug 409, which is one of the JITP plug-setting tools 250, may be deployed via a wireline 411 down the second wellbore 108*b* by the second crane 242 and second wireline unit 246. The second well 104*b* may have received a previous stimulation treatment, which has resulted in proppant fractures 412, 414, 416, 418 and 420 in the region 110*b* of the subsurface formation 112. Because these proppant fractures 412, 414, 416, 418 and 420 were previously placed in the subsurface formation 112, the operations in the second well 104*b* may be to place a composite frac plug 409 within the wellbore 108*b* above the proppant fractures 412, 414, 416, 418 and 420.

In addition to the concurrent operations being performed in the second well 104*b*, other operations may also be performed in the third well 104*c*. For example, in the third well 104*c*, proppant fractures 422, 424, 426, 428 and 430 may have been previously formed in the region 110*c* of the subsurface formation 112. Because these proppant fractures 422, 424, 426, 428 and 430 were previously formed, flowback operations may be performed to force close the proppant fractures 422, 424, 426, 428 and 430 and recover the stimulation fluid used to form the proppant fractures 422, 424, 426, 428 and 430, and produce hydrocarbons to the sales lines.

Next, FIG. 5 illustrates the wells 104*a*-104*c* after the operations performed in FIG. 4 are completed. As shown in the partial view 500, the proppant fractures 404, 406, 502, 504 and 506 were created with the pumping of the five-stage JITP treatment in FIG. 4. However, in FIG. 5, the first well 104*a* is being flowed back after the placement of proppant fractures 404, 406, 502, 504 and 506 in the region 110*a* of the subsurface formation 112 to force close the proppant fractures 404, 406, 502, 504 and 506 and recover the stimulation fluid used to place the proppant fractures 404, 406, 502, 504 and 506, and produce hydrocarbons to the sales lines.

Concurrently, the second well 104*b* may be receiving the five-stage JITP hydraulic proppant fracture treatment. It should be noted that for this stimulation operation, the main manifold valve 210 and second manifold well valve 216 are in the open position, while the first manifold well valve 214 and third manifold well valve 218 are in the closed position to create a second well flow path. Again, as discussed in FIG. 4, the wireline-deployed JITP perforating gun 408 and frac plug setting system 410 are suspended via wireline 411 in the wellbore 108*b* using the second crane 242, which is also actuated and controlled from the second wireline unit 246. However, in this view, the composite frac plug 409 is set above the proppant fracture 420. With this composite frac plug 409 installed, the five-stage JITP proppant fracture treatment is underway with the stimulation fluid pumped down the wellbore 108*b* to create proppant fracture 510.

Another concurrent operation is also being performed in the third well 104*c*. In this well, the flowback operation has been completed and the well 104*c* is now shut-in. Accordingly, to prepare for the next stimulation treatment, a wireline-deployed JITP perforating gun 512, which is another of the JITP perforating tools 248, and a frac plug setting system 514 having a composite frac plug 516, which is one of the JITP plug-setting tools 250, are deployed down the wellbore 108*c*. The JITP perforating gun 512 and a frac plug setting system 514 are suspended via wireline 403 in the wellbore 108*c* using the first crane 240, and are actuated and controlled from the first wireline unit 244. The JITP perforating gun 512 and frac plug setting system 514 may then be utilized to JITP stimulate and place additional proppant fractures above the proppant fractures 430.

Finally, FIG. 6 illustrates the wells 104*a*-104*c* after the operations performed in FIG. 5 are completed. As shown in the partial view 600, the flowback operation has been completed and the first well 104*a* has been shut-in. In this view, the wireline-deployed JITP perforating gun 601, which is another of the JITP perforating tools 248, and a frac plug setting system 602 having a composite frac plug 603, which is one of the JITP plug-setting tools 250, are deployed down the wellbore 108*a*. The JITP perforating gun 601 and frac plug setting system 602 are suspended via wireline 411 in the wellbore 108*a* using the second crane 242, and are actuated and controlled from the second wireline unit 246. The frac plug setting system 602 may be utilized to set the composite frac plug 603, while the JITP perforating gun 601 may be utilized in the next five-stage JITP treatment to create proppant fractures above proppant fracture 506 during the next stimulation treatment.

Concurrently, in the second well 104*b*, stimulation treatments are completed and the proppant fracture 510, 604, 606, 608 and 610 have been placed into the region 110*b* of the subsurface formation 112. Accordingly, the second well 104*b* is flowed back after placement of proppant fractures 510, 604, 606, 608 and 610 to force close the fractures and recover the stimulation fluid used when placing the proppant fractures, and produce hydrocarbons to the sales lines.

Also, in another concurrent operation, the composite frac plug 516 has been set in the third well 104*c* and the pumping of a five-stage JITP proppant fracture treatment has created proppant fractures 614 and 616. It should be noted that for this stimulation treatment, the main manifold valve 210 and third manifold well valve 218 are in the open position, while the first manifold well valve 214 and second manifold well valve 216 are in the closed position to create a third well fluid flow path. Again, as discussed in FIG. 5, the wireline-deployed JITP perforating gun 512 and frac plug setting system 514 are suspended via wireline 403 in the wellbore 108*c* using the first crane 240 and is actuated and controlled from the first wireline unit 244. In this view, a composite frac plug 516 is set above the proppant fracture 430. With this composite frac plug 516 installed, the JITP proppant fracture treatment is performed to form the proppant fractures 614 and 616 by having the stimulation fluid pumped down the wellbore 108*c*.

Beneficially, in this example, the concurrent operations enhance the stimulation treatment process. For instance, if the wireline running speeds is approximately 150 ft/min (feet/minute) to 300 ft/min for the assumed approximate 12,000 ft well depth, then, the time to pump a total of fifteen proppant fracture treatments is approximately ten hours. Accordingly, each well receiving the stimulation treatment may be flowed back overnight for several hours of stimulation fluid recovery and for oil and gas sales. In this manner, the stimulation treatments for multiple wells may be performed in an efficient manner that reduces time and cost.

To further explain the benefits of the present techniques, another example is described. In this example, nine wells may be drilled on a single surface pad of approximately six acres. These wells may target gas-productive reservoir targets, such as sand bodies, within a subsurface formation, and are configured to drain an area of approximately 20 acres. For these wells, the well depths may range between approximately 12,000 ft to 15,000 ft with lateral throws of approximately 1,400 ft to 2,000 ft relative to the surface pad. The size and location of the surface pad may be determined by the geological and reservoir characteristics, governmental regulations, surface topography and terrain, and consideration of environmental or regulatory requirements that are identified during the pad selection/location process. The characteristic features of the subsurface formation may be gas resources contained in multiple (e.g., 20+ to 40+) low permeability ("tight") gas sands of limited areal extent distributed over a large vertical section of approximately 4,000 ft to 6,000 ft thick interval. Accordingly, each well includes up to forty or more reservoir targets or zones.

To access these target zones, the wells are stimulated with the JITP stimulation techniques with each five stage JITP fracture treatment separated by a plug. The wireline plug-setting operation, which may be approximately two to four hours depending on well depth, running speed, and rig-up/rig-down time, may be completed while the stimulation treatment pumping operations are performed on another well. The stimulation treatment pumping operations for the five zones may be completed in approximately 3 hours. Accordingly, fifteen to twenty zones may be pumped each work day, which results in approximately two or three work days to complete a forty zone stimulation operation. Thus, by performing the stimulation operations in a concurrent manner, a total of approximately one or two work days associated with "non-pumping time" may be saved on each well during the stimulation treatments.

In addition, it should be noted that these stimulation operations may include various activities. For instance, as noted above, the stimulation operations may include pumping operations, wireline operations, flowback operations, and logistical coordination operations. Because these stimulation operations may be performed concurrently or simultaneously on different wells on a single surface pad, several risks associated with the different operations may be present. Accordingly, certain stimulation operations may be performed concurrently to reduce the risks and maintain the operational integrity of the simultaneous operations.

To begin, in performing the concurrent stimulation operations, different combinations of pumping operations, wireline operations, flowback operations, and logistical coordination operations may be performed on the different wells with certain monitoring procedures. The monitoring procedures may include using a spotter for certain operations, a light or audible warning, obtaining supervisor approval for certain operations, communicating between personnel, flagging or labeling valve positions, following lock-out tag-out procedures, and other similar processes. For instance, when the stimulation operations are being performed on the first well, operations, such as proppant delivery, chemical delivery, and/or water hauling, on the second well may be performed within designated areas and using a spotter, which is discussed below. As another example, supervisor approval may be obtained before venting gas when the operations on the other well involve high pressure pumping, manipulating pumping manifold/frac valves and gas to sales line operations. Further, when the operations on the first well involve high pressure pumping, operations on the second well, such as arming the perforating gun or setting tool and picking-up or laying down the perforating gun or setting tool, may utilize lights and audible notifications. Finally, it may be preferred to not perform certain operations concurrently. For instance, if the operations on the first well involve high pressure pumping or JITP ball sealing pressure events, the manipulating the manifold well valves and wellhead tree valves should not be concurrently performed. Also, if operations on the first well include wireless radio and cell phone communications, then the operations should not be performed concurrently with arming perforating guns and setting tools.

Another method of reducing risk may include assigning personnel to manage the operations. For instance, if a crane, such as cranes 240 and 242 of FIG. 2, are used as part of the stimulation operations, it may be preferred that the personnel operating the crane include a designated spotter to assist with crane operations. Further, the crane may be positioned to reduce potential collisions with other equipment on the surface pad. Also, based on the potential for hydraulically-energized lines associated with injection and flowback from the wells, it may be preferred that one of the personnel associated with the stimulation system manage the stimulation pumping valve positions and the flowback valve positions, while concurrent operations are being performed.

In another embodiment, it may be preferred to include monitoring equipment at the surface pad 102 of FIG. 2, which may detect gases, such as hydrocarbon gases. For example, the surface pad 102 and/or personnel may be equipped with portable Lower-Explosive Limit ("LEL") detectors. Accordingly, during flowback operations, the LEL detectors may continuously monitor the surface pad 102 for the presence of hazardous gas levels. If hazardous gas levels are detected, the flowback operations may be suspended and appropriate activities may be performed to solve any problems with equipment. Also, it may be preferred that windsocks are installed at various points and heights on the surface pad 102 to aid in determining wind direction, as well.

Further, in another alternative embodiment, it may be beneficial to have automated devices, such as processor based devices, which are utilized for the stimulation operations. For instance, the stimulation fluid pumping system 202 may be automated and controlled by a processor based device, such as a computer system. With the computer system, the stimulation treatment schedules for each individual stimulation treatment may be pre-programmed into the computer system. Also, the pumping system manifold 206 may include a processor based device, such as a computer system, as well. The computer system for the pumping system manifold 206 may include mechanisms to adjust the valves 210, 214, 216 and 218 between the open and closed positions, and communicate with the various gauges 220, 222 and 226 and ball-sealer injector 224. In fact, the computer systems of the stimulation fluid pumping system 202 and the pumping system manifold 206 may be configured to interact with each other to manage the pumping stimulation treatment process for the plurality of wells 104*a*-104*c*.

In a third alternative embodiment, the designation of specific work areas for certain operations for handling associated tools and equipment may be performed between blocks 306 and 318 of FIG. 3. That is, the process may include designating different areas, such as high-pressure pumping area, wireline/crane areas, and flowback areas, on the surface pad 102 of FIG. 2 to prevent unauthorized personnel from entering restricted areas. The designation of work areas may include providing detailed drawings of piping, valves, and flow control/measurement devices for the operations for each of the work areas and wells. For instance, if cranes 240 and 242 and wireline units 244 and 246 of FIG. 2 are used, it may be preferred that a designated wireline/crane area be located surrounding and adjacent to each of the cranes 240 and 242. Also, it may be preferred that stimulation equipment, such as the stimulation fluid pumping system 202, stimulation fluid storage system 204 and pumping system manifold 206 of FIG. 2, are arranged on the surface pad 102 with pathways or routes around the outer perimeter of the high-pressure pumping area to provide access for reloading of stimulation materials and supplies. Further, it may be preferred that piping and valves be identified using different unique colored markings or other labels for each of the different wells to assist in visual observations and understanding of the flow paths and equipment tie-in points.

Also, in a fourth alternative embodiment, it may be preferable for a communication protocol to be established between blocks 306 and 318 of FIG. 3. For example, when executing simultaneous wireline operations, if select-fire perforating guns are used, it may be preferred that wireless communication devices, such as radios and other cellular devices, are turned off and/or stored in a central location when a gun is armed and placed in the wellbore or removed from the wellbore. Alternatively, it may be preferred that "hard-wired" radios and communication devices are used as the primary communication devices with wireless communication devices only utilized as back-up equipment. Further, strobe-warning lights and/or a loudspeaker system may be used to provide an indication of the status of the gun arming sequence and depth of gun during the operations.

It should be noted that the pumping system manifold 206 of FIG. 2 may not include each of the components described above. Indeed, in alternative embodiments, additional measurement devices, flow control devices, fluid injection or withdrawal ports, and/or material injection or withdrawal ports may be included in the pumping system manifold 206 and/or upstream or downstream of the pumping system manifold 206.

Furthermore, it should also be noted that the number of wells and geometry of the surface location may be influenced by a number of factors to conform to appropriate regulatory requirements and other factors. Accordingly, wells may possess vertical, deviated, S-shaped, and/or horizontal trajectories. For example, these trajectories may target multiple hydrocarbon bearing targets being drilled, stimulated, and completed on approximately ⅝ acre spacing in low-permeability oil fields; on approximately 10 to 40 acre well spacing in tight gas fields; and on approximately 40 acre, 80 acre and/or 160 acre spacing associated with in-fill drilling processes. Also, wells may be completed as cased-hole completions or open-hole completions. In addition, the present techniques may include a single unique surface area (i.e. pad) or two or more surface pads in sufficiently close proximity for performing the drilling, stimulation, completion, and production operations objectives. The possible use of wells from two or more surface pads may be determined based on local geographic conditions, material supply routes, and/or overall field infrastructure, specific operational requirements, and/or economic considerations.

As noted above, the present techniques may also be used for stimulation treatments involving hydraulic fracturing or acid stimulation in production or injection wells. Hydraulic fracturing may include injecting fluids into a formation at high pressures and rates that the reservoir rock fails and granular proppant material, such as sand, ceramic beads, or other materials, is injected to hold the fracture(s) open. Increased reservoir production capacity or injection capacity results from the flow path left between the grains of the proppant material within the fracture(s). In chemical stimulation treatments, such as matrix acidizing treatments or acid fracturing treatments, flow capacity is improved by dissolving materials in the formation or otherwise changing formation properties.

Moreover, the present techniques may be used for stimulation treatments involving multiple stage treatments or single-stage treatments. Multiple stage stimulation treatments may include the JITP or ACT-Frac treatment methods, which are discussed above. In addition, the multiple stage stimulation treatments may include other multiple stage treatments, such as stimulation treatments disclosed in U.S. Pat. No. 5,890,536 and U.S. Pat. No. 6,186,230, which are herein incorporated by reference. Also, other methods utilized in oil and gas operations, such as "limited-entry" diverted multi-stage treatments, annular coiled-tubing, coiled-tubing, ball-sealer multi-stage treatments, modified limited entry multi-stage treatments, induced stress diverted treatments, or multiple single-stage treatments separated by plugs, or any combination of treatments, may also be utilized with the present techniques.

In addition, it should be appreciated that the surface pad, such as surface pad 102, may include two or more stimulation fluid pumping systems. For instance, a surface pad may include two stimulation fluid pumping system, which are stimulation fluid pumping system 202 of FIG. 2. This configuration for the surface pad may also include two stimulation storage systems 204, two pumping system manifolds 206, and other associated piping. Each of the stimulation storage systems, pumping system manifolds, and other associated piping may each be associated with two different groups or sets of wells. In this manner, two wells may be stimulated concurrently or simultaneously. That is, one well associated with each of the stimulation fluid pumping systems may receive stimulation treatments, while other wells from the well groups may be prepared for stimulation treatments.

While the present techniques of the invention may be susceptible to various modifications and alternative forms, the exemplary embodiments discussed above have been shown by way of example. However, it should again be understood that the invention is not intended to be limited to the particular embodiments disclosed herein. Indeed, the present techniques of the invention are to cover all modifications, equivalents, and alternatives falling within the spirit and scope of the invention as defined by the following appended claims.

What is claimed is:

1. A method associated with the production of hydrocarbons comprising:

providing a pumping system manifold for connecting a stimulation fluid pumping system simultaneously to at least two wells, the pumping system manifold being selectively switchable between directing a pressurized hydraulic stimulation treatment to one of the at least two wells and isolating the pressurized hydraulic stimulation treatment from the other of the at least two wells;

connecting the at least two wells to the pumping system manifold, each of the at least two wells including a wellbore conduit for receiving the pressurized hydraulic stimulation treatment from the pumping system manifold;

providing wellbore conduit mechanical access equipment on each of the at least two wells, the wellbore conduit mechanical access equipment comprising equipment for at least one of a wireline system, a coiled tubing system, a wireline perforating system, an autonomous perforating system, a plug-setting system, and a stimulation fluid flowback system, pumping a first stimulation treatment through the pumping system manifold and into a first well of the at least two wells while selectively isolating a second well of the at least two wells from fluid pressure of the first stimulation treatment, the first stimulation treatment comprising at least one of a hydraulic proppant fracture treatment, an acid fracture treatment, a matrix acid treatment, and combinations thereof; and preparing the second well of the at least two wells for a second stimulation treatment, the step of preparing the second well performed by a method comprising using the provided wellbore conduit mechanical access equipment while concurrently, pumping the first stimulation treatment, wherein preparing the second well comprises performing at least one of a wireline operation, coiled tubing operation, wireline perforating operation, autonomous perforating operation, plug-setting operation, and stimulation fluid flowback operation, within the wellbore conduit of the second well.

2. The method of claim 1 further comprising adjusting the pumping system manifold to provide a first well flow path from the stimulation fluid pumping system to the first well, wherein adjusting the pumping system manifold comprises configuring at least one of a plurality of valves to provide the first well flow path and configuring at least one of the plurality of valves to isolate the first stimulation treatment from entering the second well.

3. The method of claim 1 further comprising adjusting the pumping system manifold to provide a second well flow path from the stimulation fluid pumping system to the second well while isolating the first well from the second well and the stimulation fluid pumping system.

4. The method of claim 3 further comprising pumping the second stimulation treatment in the second well while performing at least one operation on the first well different than pumping stimulation treatment.

5. The method of claim 1 wherein the first stimulation treatment comprises at least one treatment selected from just-in-time perforating, annular coiled-tubing, coiled-tubing, limited-entry, ball-sealer, modified limited entry, induced stress diverted, one or more single-stage stimulation treatments separated by isolation elements, and any combination thereof.

6. The method of claim 1 wherein the first stimulation treatment comprises at least one treatment selected from a multi-zone just-in-time perforating hydraulic proppant fracture stimulation treatment, a multi-zone annular coiled tubing fracture stimulation treatment, and any combination thereof.

7. The method of claim 1 further comprising producing hydrocarbons from the at least two wells.

8. The method of claim 1 further comprising drilling the at least two wells from a single surface pad.

9. The method of claim 1 wherein the at least two wells are located on a single surface pad.

10. The method of claim 1 wherein the at least two wells are in proximity to each other on one or more surface pads or platforms.

11. The method of claim 1 further comprising installing production tubing into at least one of the at least two wells.

12. The method of claim 1 further comprising performing at least one safety operation concurrently with pumping the first stimulation treatment and preparing the second well, wherein the safety operation is adapted to isolate the pumping of the first stimulation treatment and the preparing of the second well from each other.

13. The method of claim 1, wherein the wellbore conduit mechanical access equipment further comprises at least one of a perforating gun, a pack-off device, a lubricator device, a coil tubing injector head, tool retaining and releasing equipment, a stripping head, stimulation fluid flowback control equipment, and combinations thereof.

14. The method of claim 1, further comprising isolating the provided wellbore conduit mechanical access equipment on the first well from the fluid pressure of the first stimulation treatment during the first stimulation treatment.

15. A method associated with the production of hydrocarbons comprising:

connecting a first well and a second well to a first stimulation fluid pumping system via a first pumping system manifold;

connecting a third well and a fourth well to a second stimulation fluid pumping system via a second pumping system manifold;

wherein the third and fourth wells are hydraulically isolated from the pressure and energy created by the first stimulation pumping system;

adjusting the first pumping system manifold to provide a first stimulation treatment to the first well and to hydraulically isolate the second well from the pressure and energy created by the first stimulation treatment for other operations;

adjusting the second pumping system manifold to provide a second stimulation treatment to the third well and to hydraulically isolate the fourth well from the pressure and energy created by the second stimulation treatment;

pumping the first stimulation treatment into the first well, the first stimulation treatment comprising at least one of a hydraulic proppant fracture treatment, an acid fracture treatment, a matrix acid treatment, and combinations thereof;

pumping the second stimulation treatment into the third well concurrently with the pumping of the first stimulation treatment; and preparing at least one of the second well and the fourth well for a stimulation treatment, wherein preparing the second well occurs concurrently with the pumping of at least one of the first well stimulation treatment and a third well stimulation treatment;

wherein preparing the at least one of the second well and the fourth well comprises performing at least one of a wireline operation, coiled tubing operation, wireline perforating operation, autonomous perforating operation, plug-setting operation, and stimulation fluid flowback operation.

16. The method of claim 15 further comprising:

preparing the second well for the third stimulation treatment concurrently with the pumping of the first stimulation treatment; and preparing the fourth well for a fourth stimulation treatment concurrently with the pumping of the second stimulation treatment.

17. The method of claim 16 wherein preparing the second well for the third stimulation treatment comprises disposing at least one tool in the second well, wherein the at least one tool is selected from a just-in-time perforating tool, an annular coiled tubing based tool, a limited-entry perforating tool, a ball-sealer tool, an isolation element, and any combination thereof.

18. The method of claim 15 wherein at least one of the first stimulation treatment and the second stimulation treatment comprises at least one treatment selected from a multi-zone just-in-time perforating hydraulic proppant fracture stimulation treatment, a multi-zone annular coiled tubing fracture stimulation treatment, and any combination thereof.

19. The method of claim 15 further comprising producing hydrocarbons from the first well once the first stimulation treatment is completed.

20. The method of claim 15 further comprising drilling the first well, second well, third well and fourth well from a single surface pad.

21. The method of claim 15 wherein the first well, second well, third well and fourth well are located on a single surface pad.

22. The method of claim 15 wherein the first well, second well, third well and fourth well are in proximity to each other on one or more surface pads or platforms.

23. The method of claim 15 comprising installing production tubing into at least one of the first well, the second well, the third well, and the fourth well.

24. A method of stimulating multiple wells, the method comprising:

connecting a plurality of wells to a stimulation fluid pumping system via a pumping system manifold;

pumping a first stimulation treatment fluid into a first well through a first fluid line connected to the pumping system manifold; and simultaneously pumping a second stimulation treatment fluid into a second well through a second line connected to the pumping system manifold;

wherein the second well is hydraulically isolated from the first stimulation treatment.

25. The method of claim 24 wherein the first well and the second well are on one or more surface pads or platforms.

26. The method of claim 24 wherein at least one of the first stimulation treatment fluid and the second stimulation treatment fluid is selected for use in a stimulation treatment selected from one or more of a hydraulic proppant fracture treatment, an acid fracture treatment, and a matrix acid treatment.

27. The method of claim 24 further comprising producing hydrocarbons from the plurality of wells.

28. The method of claim 24 further comprising drilling the plurality of wells from a single surface pad.

29. The method of claim 24 wherein the plurality of wells are located on a single surface pad.

30. The method of claim 24 wherein the plurality of wells are in proximity to each other on one or more surface pads or platforms.

31. The method of claim 24 further comprising installing production tubing into at least one of the plurality of wells.

* * * * *